US009181819B2

(12) United States Patent
Lee et al.

(10) Patent No.: US 9,181,819 B2
(45) Date of Patent: Nov. 10, 2015

(54) COMPONENT WALL HAVING DIFFUSION SECTIONS FOR COOLING IN A TURBINE ENGINE

(75) Inventors: Ching-Pang Lee, Cincinnati, OH (US); Jae Y. Um, Winter Garden, FL (US); Mrinal Munshi, Orlando, FL (US); Humberto A. Zuniga, Casselberry, FL (US)

(73) Assignee: Siemens Energy, Inc., Orlando, FL (US)

( * ) Notice: Subject to any disclaimer, the term of this patent is extended or adjusted under 35 U.S.C. 154(b) by 885 days.

(21) Appl. No.: 12/813,624

(22) Filed: Jun. 11, 2010

(65) Prior Publication Data

US 2011/0305583 A1 Dec. 15, 2011

(51) Int. Cl.
*F01D 5/18* (2006.01)
*F01D 25/12* (2006.01)

(52) U.S. Cl.
CPC *F01D 25/12* (2013.01); *F01D 5/18* (2013.01); *F01D 5/186* (2013.01); *Y10T 29/4932* (2015.01)

(58) Field of Classification Search
CPC ..... F01D 5/18; F01D 5/182; F01D 5/186; F05D 2230/30; F05D 2230/31; F05D 2230/90; F05D 2260/202; F05D 2260/22141
USPC ..... 416/97 A, 97 R, 96 R; 415/115, 116
See application file for complete search history.

(56) References Cited

U.S. PATENT DOCUMENTS 5,458,461 A 10/1995 Lee et al.
5,605,639 A * 2/1997 Banks et al. ..... 219/69.17
5,651,662 A 7/1997 Lee et al.
5,660,525 A 8/1997 Lee et al.
5,683,600 A 11/1997 Kelley et al.
5,902,647 A * 5/1999 Venkataramani et al. .... 427/454
6,234,755 B1 * 5/2001 Bunker et al. ..... 416/97 R (Continued)

FOREIGN PATENT DOCUMENTS

EP 1043480 A2 10/2000
EP 1091090 A2 4/2001

(Continued)

OTHER PUBLICATIONS

Lu, Y. "Effect of hole configuration on film cooling from cylindrical inclined holes for the application to gas turbine blades". Ph.D. dissertation, Louisiana State University, Dec. 2007.*

(Continued)

*Primary Examiner* — Sean J Younger

(57) ABSTRACT

A film cooling structure formed in a component wall of a turbine engine and a method of making the film cooling structure. The film cooling structure includes a plurality of individual diffusion sections formed in the wall, each diffusions section including a single cooling passage for directing cooling air toward a protuberance of a wall defining the diffusion section. The film cooling structure may be formed with a masking template including apertures defining shapes of a plurality of to-be-formed diffusion sections in the wall. A masking material can be applied to the wall into the apertures in the masking template so as to block outlets of cooling passages exposed through the apertures. The masking template can be removed and a material may be applied on the outer surface of the wall such that the material defines the diffusion sections once the masking material is removed.

18 Claims, 9 Drawing Sheets

(56) References Cited

U.S. PATENT DOCUMENTS

| | | | | |
|---|---|---|---|---|
| 6,307,175 | B1 | 10/2001 | Blochlinger et al. | |
| 6,383,602 | B1 | 5/2002 | Fric et al. | |
| 6,617,003 | B1 * | 9/2003 | Lee et al. | 428/131 |
| 7,328,580 | B2 | 2/2008 | Lee et al. | |
| 7,351,036 | B2 | 4/2008 | Liang | |
| 7,411,150 | B2 * | 8/2008 | Lavers et al. | 219/121.71 |
| 7,553,534 | B2 | 6/2009 | Bunker | |
| 2008/0057271 | A1 | 3/2008 | Bunker | |
| 2008/0298920 | A1 * | 12/2008 | Janssen et al. | 409/131 |
| 2009/0067998 | A1 * | 3/2009 | Beck et al. | 415/175 |
| 2009/0246011 | A1 | 10/2009 | Itzel | |
| 2011/0293423 | A1 * | 12/2011 | Bunker et al. | 416/95 |

FOREIGN PATENT DOCUMENTS

| | | | |
|---|---|---|---|
| EP | 1609949 | A1 | 12/2005 |
| GB | 2438861 | A1 | 12/2007 |
| JP | 10089005 | A | 4/1998 |
| JP | 2001173405 | A | 6/2001 |
| JP | 2005522633 | A | 7/2005 |
| JP | 2006009785 | A | 1/2006 |
| JP | 2008248733 | A | 10/2008 |
| JP | 2011247248 | A | 12/2011 |

OTHER PUBLICATIONS

Varvel, T. "Shaped Hole Effects on Film Cooling Effectiveness and a Comparison of Multiple Effectiveness Measurement Techniques". Master od Science Thesis, Texas A&M University, Dec. 2004.*

Colban, W. "A Detailed Study of Fan-Shaped Film-Cooling for a Nozzle Guide Vane for an Industrial Gas Turbine". Ph.D dissertation, Virginia Polythechnic Institute and State University, Nov. 2005.*

Ching-Pang Lee et al.; U.S. patent application entitled "Film Cooled Component Wall in a Turbine Engine".

* cited by examiner

COMPONENT WALL HAVING DIFFUSION SECTIONS FOR COOLING IN A TURBINE ENGINE

FIELD OF THE INVENTION

The present invention relates to turbine engines, and, more particularly, to cooling structure provided in a component wall, such as an airfoil in a gas turbine engine.

BACKGROUND OF THE INVENTION

In a turbomachine, such as a gas turbine engine, air is pressurized in a compressor then mixed with fuel and burned in a combustor to generate hot combustion gases. The hot combustion gases are expanded within a turbine of the engine where energy is extracted to power the compressor and to provide output power used to produce electricity. The hot combustion gases travel through a series of turbine stages. A turbine stage may include a row of stationary airfoils, i.e., vanes, followed by a row of rotating airfoils, i.e., turbine blades, where the turbine blades extract energy from the hot combustion gases for powering the compressor and providing output power.

Since the airfoils, i.e., vanes and turbine blades, are directly exposed to the hot combustion gases as the gases pass through the turbine, these airfoils are typically provided with internal cooling circuits that channel a coolant, such as compressor bleed air, through the airfoil and through various film cooling holes around the surface thereof. For example, film cooling holes are typically provided in the walls of the airfoils for channeling the cooling air through the walls for discharging the air to the outside of the airfoil to form a film cooling layer of air, which protects the airfoil from the hot combustion gases.

SUMMARY OF THE INVENTION

In accordance with a first aspect of the present invention, a component wall is provided in a turbine engine. The component wall comprises a substrate having a first surface and a second surface opposed from the first surface, and a plurality of diffusion sections located in the second surface. Each diffusion section is defined by a bottom surface between the first and second surfaces, an open top portion located at the second surface, and wall structure extending from the bottom surface to the second surface. The wall structure surrounds the respective diffusion section and comprises at least a first sidewall and a second sidewall opposed from the first sidewall. The first sidewall of each diffusion section comprises a protuberance extending toward the second sidewall of the respective diffusion section. Each diffusion section comprises a single cooling passage, the cooling passage of each diffusion section extending through the substrate from the first surface to the bottom surface of the respective diffusion section. An outlet of each cooling passage is arranged within the respective diffusion section such that cooling air exiting each cooling passage through the outlet is directed toward the protuberance of the respective first sidewall.

In accordance with a second aspect of the present invention, a component wall is provided in a turbine engine. The component wall comprises a substrate having a first surface and a second surface opposed from the first surface and a plurality of diffusion sections located in the second surface. Each diffusion section defined by a bottom surface between the first and second surfaces, an open top portion located at the second surface, and wall structure extending from the bottom surface to the second surface. The wall structure surrounds the respective diffusion section and comprises a first sidewall, a second sidewall opposed from the first sidewall, a third sidewall extending between the first and second sidewalls, and a fourth sidewall opposed from the third sidewall and extending between the first and second sidewalls. The bottom surface of each diffusion section is substantially parallel to the second surface and extends from the third sidewall to the fourth sidewall. The first sidewall of each diffusion section is substantially perpendicular to the second surface and comprises a protuberance extending toward the second sidewall of the respective diffusion section. Each diffusion section comprises a single cooling passage, the cooling passage of each diffusion section extending through the substrate from the first surface to the bottom surface of the respective diffusion section. An outlet of each cooling passage is arranged within the respective diffusion section such that cooling air exiting each cooling passage through the outlet is directed toward an apex of the respective protuberance to effect a diverging flow of cooling air along the respective first sidewall In accordance with a third aspect of the present invention, a method is provided of forming cooling structure in a component wall of a turbine engine. An outer surface of an inner layer of the component wall is masked with a masking template. The masking template includes apertures defining shapes of a plurality of to-be-formed diffusion sections in the component wall. The apertures are spaced from each other corresponding to spacing between outlets of cooling passages extending through the inner layer of the component wall such that the outlets of the cooling passages are exposed through the apertures. A masking material is applied to the component wall into the apertures in the masking template so as to block the outlets of the cooling passages. The masking template is removed and a material is applied on the outer surface of the inner layer to form an outer layer of the component wall over the inner layer. The outer layer surrounds the plurality of to-be-formed diffusion sections in the component wall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
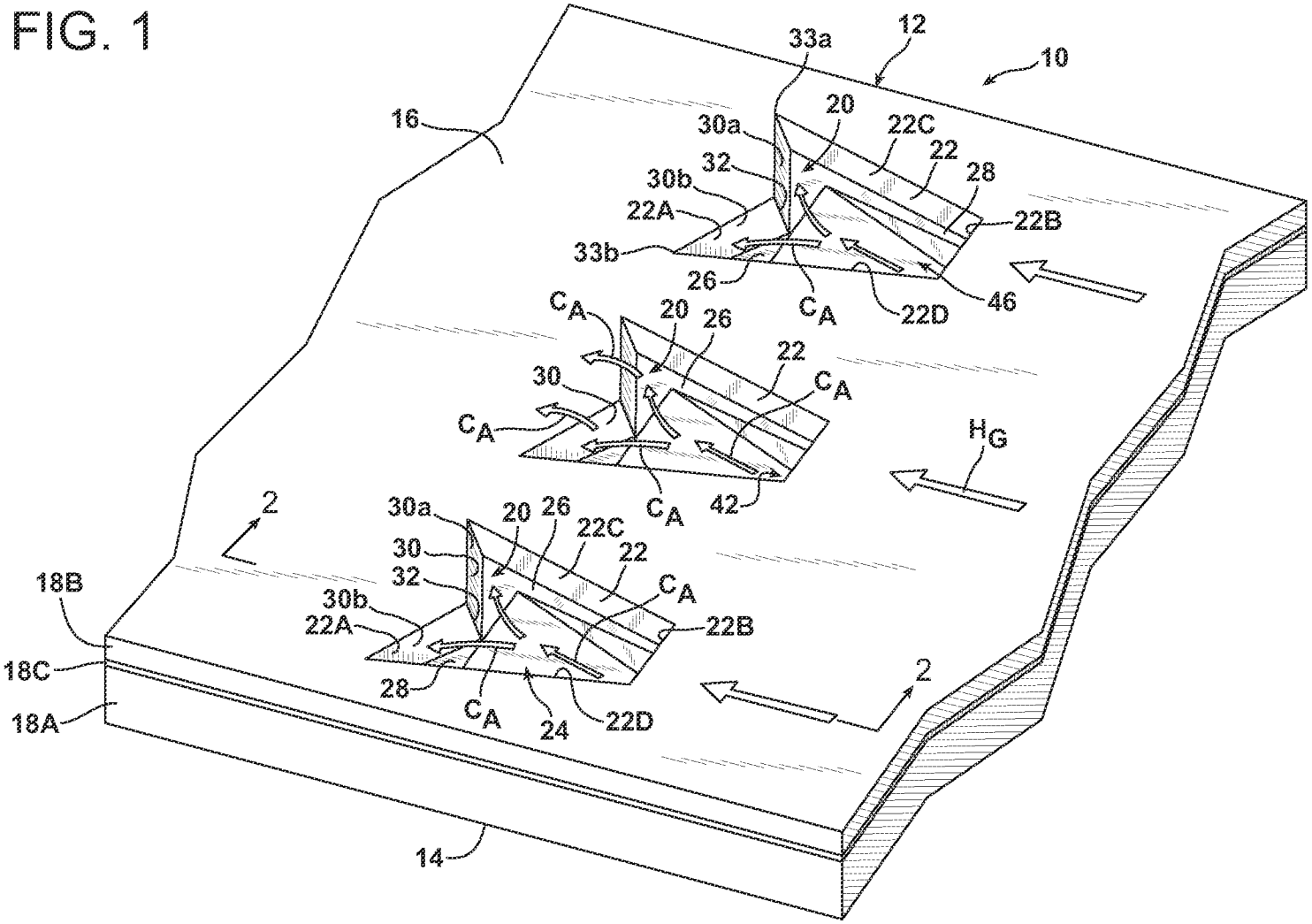
FIG. 1 is a perspective view of a portion of a film cooled component wall according to an embodiment of the invention.
Figure 2:
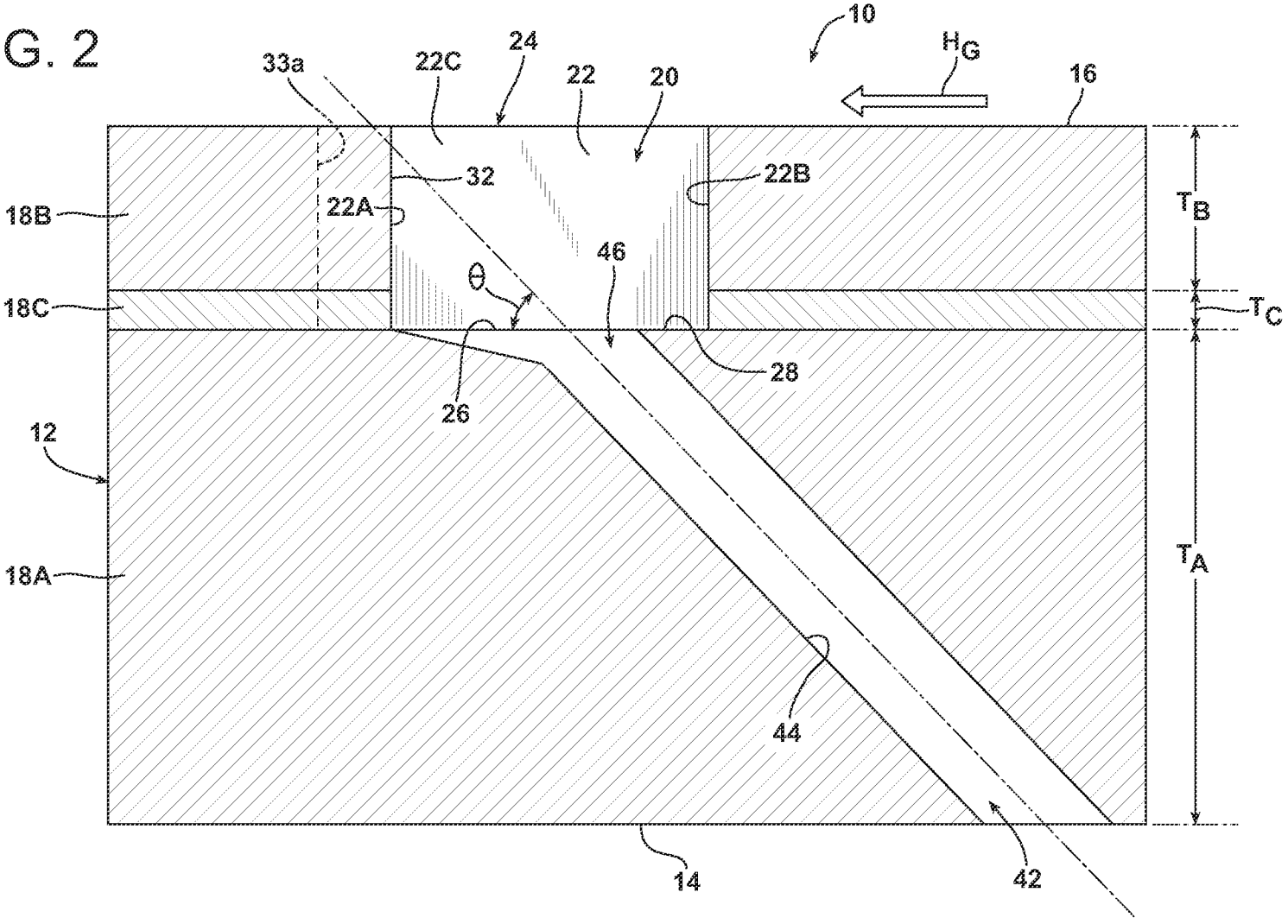
FIG. 2 is a side cross sectional view of the film cooled component wall taken along line 2-2 in FIG. 1.
Figure 3:
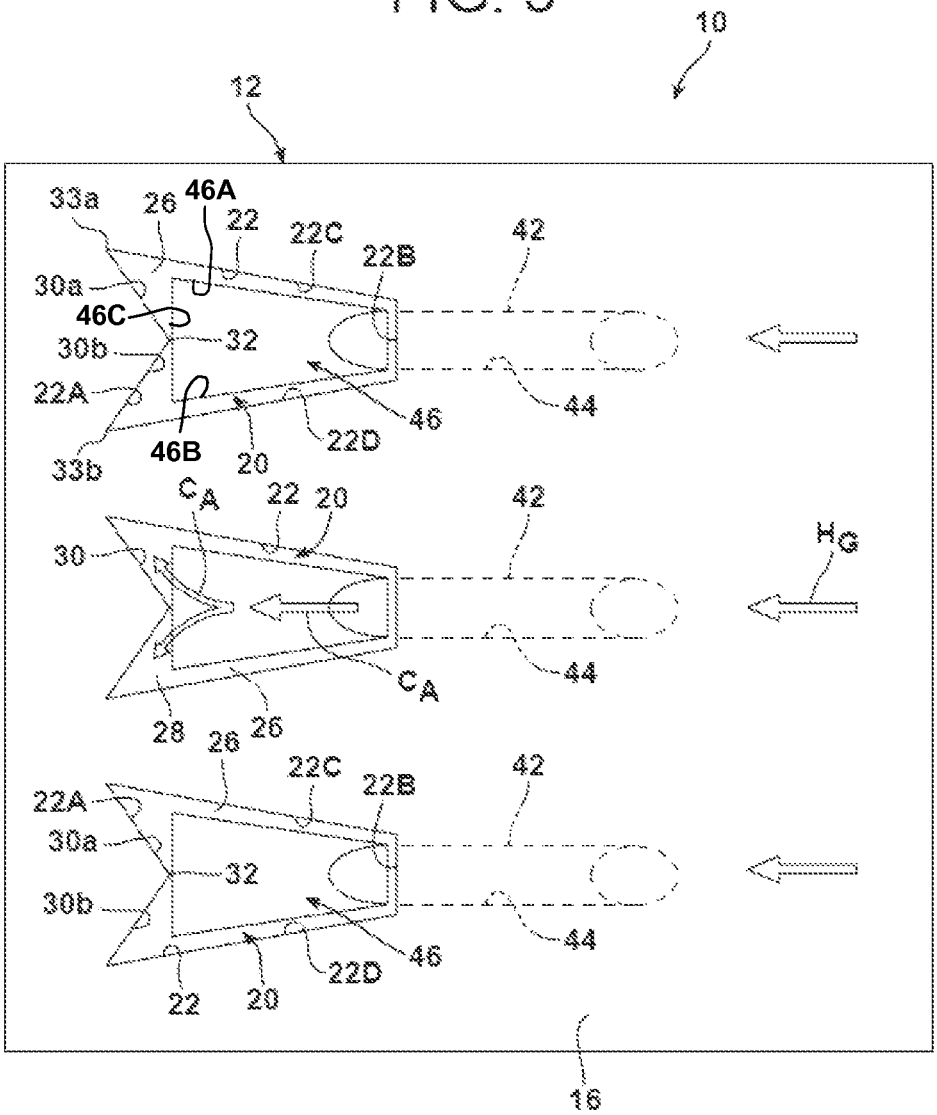
FIG. 3 is a plan view of the film cooled component wall shown in FIG. 1.

Referring to FIGS. 1-3, a film cooled component wall 10 according to an embodiment of the invention is shown. The component wall 10 may comprise a portion of a component in a turbine engine, such as an airfoil, i.e., a rotating turbine blade or a stationary vane, a combustor liner, an exhaust nozzle, and the like.

The component wall 10 comprises a substrate 12 having a first surface 14 and a second surface 16. The first surface 14 may be referred to as the "cool" surface, as the first surface 14 may be exposed to cooling air, while the second surface 16 may be referred to as the "hot" surface, as the second surface 16 may be exposed to hot combustion gases during operation. Such combustion gases may have temperatures of up to about 2,000° C. during operation of the engine. In the embodiment shown, the first surface 14 and the second surface 16 are opposed and substantially parallel to each other.

The material forming the substrate 12 may vary depending on the application of the component wall 10. For example, for turbine engine components, the substrate 12 preferably comprises a material capable of withstanding typical operating conditions that occur within the respective portion of the engine, such as, for example, ceramics and metal-based materials, e.g., steel or nickel, cobalt, or iron based superalloys, etc.

Referring to FIGS. 1 and 2, the substrate 12 may comprise one or more layers, and in the embodiment shown comprises an inner layer 18A, an outer layer 18B, and an intermediate layer 18C between the inner and outer layers 18A, 18B. The inner layer 18A in the embodiment shown comprises, for example, steel or a nickel, cobalt, or iron based superalloy, and, in one embodiment, may have a thickness $T_A$ of about 1.2 mm to about 2.0 mm, see FIG. 2. The outer layer 18B in the embodiment shown comprises a thermal barrier coating that is employed to provide a high heat resistance for the component wall 10, and, in one embodiment, may have a thickness $T_B$ of about 0.5 mm to about 1.0 mm, see FIG. 2. The intermediate layer 18C in the embodiment shown comprises a bond coat that is used to bond the outer layer 18B to the inner layer 18A, and, in one embodiment, may have a thickness $T_C$ of about 0.1 mm to about 0.2 mm, see FIG. 2. While the substrate 12 in the embodiment shown comprises the inner, outer, and intermediate layers 18A, 18B, 18C, it is understood that substrates having additional or fewer layers could be used. For example, the thermal barrier coating, i.e., the outer layer 18B, may comprise a single layer or may comprise more than one layer. In a multi-layer thermal barrier coating application, each layer may comprise a similar or a different composition and may comprise a similar or a different thickness.

As shown in FIGS. 1-3, a plurality of diffusion sections 20, also referred to as craters, trenches, or slots, are formed in the component wall 10. The diffusion sections 20 may be formed in the second surface 16 of the substrate 12, i.e., the diffusion sections 20 may extend through the outer layer 18B or both the outer and intermediate layers 18B, 18C in the embodiment shown (see FIG. 2).

The diffusion sections 20 each comprise wall structure 22 that surrounds the respective diffusion section 20, an open top portion 24 located at the second surface 16 of the substrate 12, and a bottom surface 26. The wall structure 22 extends between the bottom surface 26 and the second surface 16 of the substrate 12. In the embodiment shown the wall structure 22 comprises a first sidewall 22A, a second sidewall 22B spaced from the first sidewall 22A, a third sidewall 22C extending between the first and second sidewalls 22A and 22B, and a fourth sidewall 22D spaced from the third sidewall 22C and also extending between the first and second sidewalls 22A and 22B. As shown in FIG. 3, the bottom surface 26 of each diffusion section 20 extends from the third sidewall 22C to the fourth sidewall 22D. It is noted that the first sidewall 22A is downstream from the second sidewall 22B with respect to a direction of hot gas $H_G$ (see FIGS. 1-3) flow during operation, as will be described in greater detail herein.

The first, second, third, and fourth sidewalls 22A-22D each extend outwardly continuously from the bottom surface 26 of the each diffusion section 20 to the second surface 16 of the substrate 12. That is, the first, second, third, and fourth sidewalls 22A-22D extend continuously generally perpendicular between the bottom surface 26 and the second surface 16. Further, in the embodiment shown the first, second, third, and fourth sidewalls 22A-22D are each substantially perpendicular to the second surface 16 of the substrate 12 and also to the bottom surface 26 of the respective diffusion section 20. Moreover, the second sidewall 22B of each diffusion section 20 according to this embodiment comprises a generally straight wall section extending from the third sidewall 22C to the fourth sidewall 22D, as shown most clearly in FIG. 3

The bottom surface 26 in the embodiment shown is defined by an outer surface 28 of the inner layer 18A of the substrate 12, as shown in FIGS. 1-3. In the embodiment shown, the bottom surface 26 is substantially parallel to the second surface 16 of the substrate 12 and also to the first surface 14 of the substrate 12.

Figure 9:
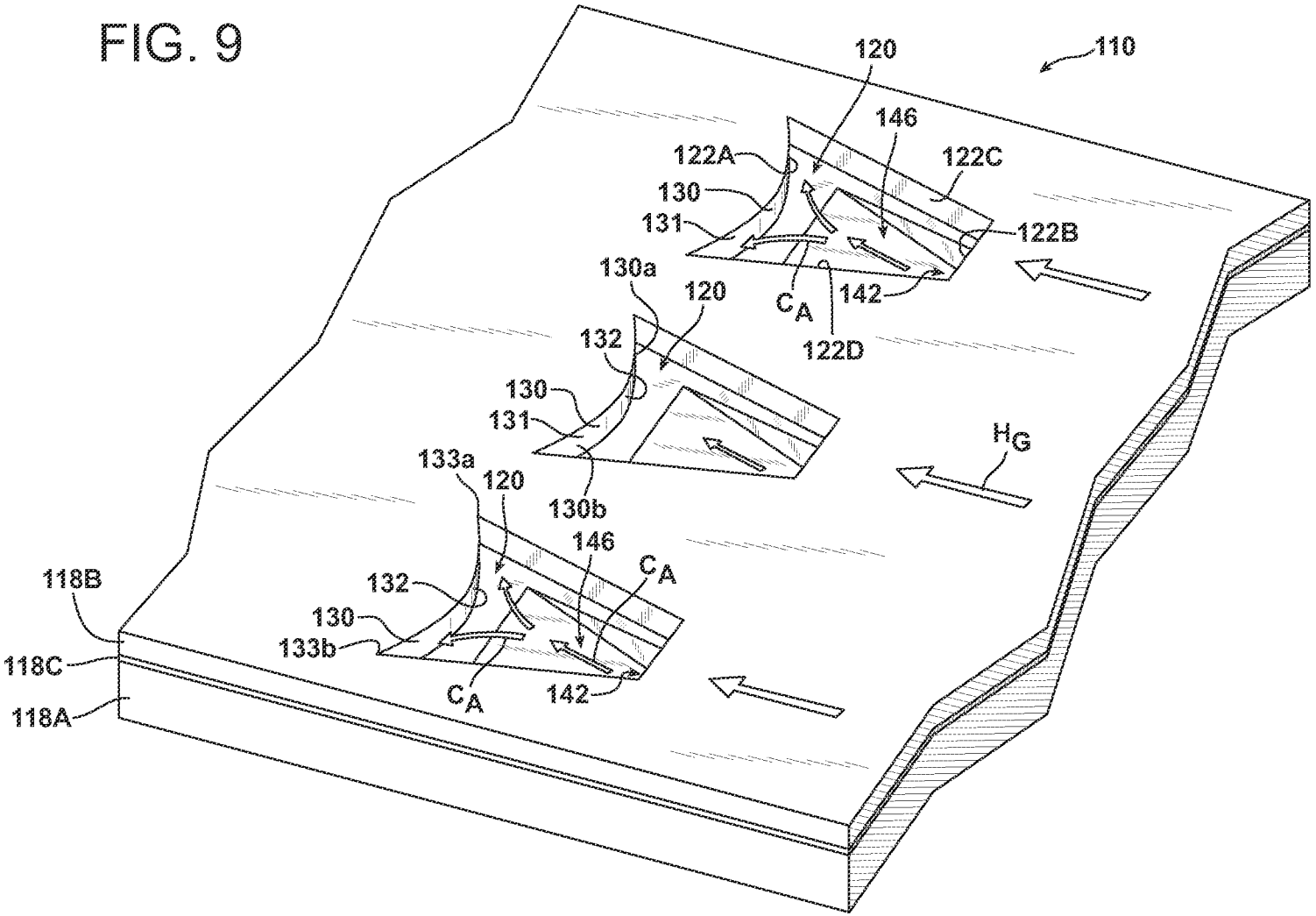
FIG. 9 is a perspective view of a film cooled component wall according another embodiment of the invention.

As shown most clearly in FIGS. 1 and 3, the first sidewall 22A of each diffusion section 20 comprises a single protuberance 30, which may also be referred to as a bump, bulge, etc., which protuberance 30 extends axially or generally parallel to the direction of hot gas $H_G$ flow toward the second sidewall 22B of the respective diffusion section 20. Each protuberance 30 according to this embodiment comprises an apex 32 and adjacent wall portions 30a, 30b extending at an angle to each other in diverging relation, in the direction of hot gas $H_G$ flow, from the apex 32 to respective junctions 33*a*, 33*b* with the third and fourth sidewalls 22C, 22D. While the shape of each protuberance 30 may vary, the shape is configured so as to effect a diverging flow of cooling air $C_A$ (see FIG. 1) along the first sidewall 22A during operation to change the direction of the flow of cooling air $C_A$ from generally parallel to the hot gas $H_G$ flow to transverse to the hot gas $H_G$ flow, as will be discussed in detail herein. Further, while the protuberance 30 of each diffusion section 20 in the embodiment shown comprises generally the same shape, it is understood that one or more of the protuberances 30 may comprise one or more different shapes. It is also noted that the apexes 32 of the protuberances 30 can comprise sharp angles, as shown in FIGS. 1-3, or can be rounded to various degrees, as shown in FIG. 9, as will be described herein, and provide the diffusion sections with different exit portion shapes than exit portion shapes of cooling passages associated with the respective diffusion sections, as most clearly shown in FIGS. 1, 3, and 9.

Referring to FIGS. 1-3, each diffusion section 20 comprises a single cooling passage 42 extending through the substrate 12 from the first surface 14 of the substrate 12 to the bottom surface 26 of the respective diffusion section 20, i.e., the cooling passage 42 of each diffusion section 20 extends through the first layer 18A in the embodiment shown. In this embodiment, each cooling passage 42 is inclined, i.e., extends at an angle θ through the substrate 12, as shown in FIG. 2. The angle θ may be, for example, about 15 degrees to about 60 degrees relative to a plane defined by the bottom surface 26, and in a preferred embodiment is between about 30 degrees to about 45 degrees.

The diameter of the cooling passages 42 may be uniform along their length or may vary. For example, throat portions 44 of the cooling passages 42 (see FIGS. 2 and 3) may be substantially cylindrical, while outlets 46 of the cooling passages 42 may be elliptical, diffuser-shaped, or may have any other suitable geometry. It is noted that the outlet 46 of each cooling passage 42 is the region at which that cooling passage 42 terminates at the bottom surface 26 of the respective diffusion section 20. As shown most clearly in FIG. 3, the cooling passage outlet 46 includes opposed first and second side edges 46A, 46B and a distal edge 46C located at the bottom surface 26 of the diffusion section 20. It is also noted that, if the outlets 46 of the cooling passages 42 comprise diffuser shapes, the portions of the substrate 12 that define the boundaries of an outlet 46 may be angled about 10 degrees relative to the axis of the respective cooling passage 42. Also, the third and fourth sidewalls 22C, 22D are shown as diverging from each other, see FIGS. 1 and 3. Specifically, each of the third and fourth sidewalls 22C, 22D may be angled about 10 degrees relative to an axis of a respective cooling passage 42. As shown in FIG. 3, the third sidewall 22C of the diffusion section 20 is generally parallel to the first side edge 46A of the cooling passage outlet 46 and the fourth sidewall 22D of the diffusion section 20 is generally parallel to the second side edge 46B of the cooling passage outlet 46.

As shown in FIGS. 1 and 3, the outlet 46 of each cooling passage 42 is arranged within the respective diffusion section 20 between the first, second, third, and fourth sidewalls 22A-22D of the respective diffusion section 20 such that the outlet 46 is axially aligned with the apex 32 of the respective protuberance 30. Hence, the cooling air $C_A$ exiting each cooling passage 42 through the outlet 46 thereof is directed toward the protuberance 30 of the respective first sidewall 22. This configuration advantageously allows the cooling air $C_A$ to flow toward the apex 32 of each protuberance 30 so as to effect a diverging flow of the cooling air $C_A$ along the adjacent respective wall portions 30*a*, 30*b* during operation, as indicated by the solid line arrows in FIGS. 1 and 3.

In operation, the cooling air $C_A$, which may comprise, for example, compressor discharge air or any other suitable cooling fluid, travels from a source of cooling air (not shown) to the cooling passages 42. The cooling air $C_A$ flows through the cooling passages 42 and exits the cooling passages 42 via the outlets 46 thereof into the corresponding diffusion sections 20.

Subsequent to the cooling air $C_A$ flowing out of the outlet 46 of each cooling passage 42, the cooling air $C_A$ flows toward the apex 32 of the protuberance 30 of the respective first sidewall 22A. As shown in FIGS. 1 and 3, the apex 32 of each first sidewall 22A effects a diverging flow of the cooling air $C_A$ along the adjacent wall portions 30*a*, 30*b* so as to spread the cooling air $C_A$ within the corresponding diffusion section 20. The cooling air $C_A$ flows generally along adjacent wall portions 30*a*, 30*b* toward the junctions 33*a*, 33*b* and spreads within the diffusion section 20. The spreading of the cooling air $C_A$ within the diffusion sections 20 creates a "sheet" of cooling air $C_A$ within substantially each entire diffusion section 20 and improves film coverage of the cooling air $C_A$ within each diffusion section 20. Hence, film cooling downstream of each diffusion section 20 provided by the cooling air $C_A$ is believed to be increased.

The hot gas $H_G$ flows along the second surface 16 of the substrate 12 toward the diffusion sections 20, as shown in FIGS. 1-3. Since the cooling air $C_A$ in the diffusion sections 20 forms a sheet of cooling air $C_A$ within each diffusion section 20 as discussed above, hot gas $H_G$ mixing with cooling air $C_A$ in the diffusion sections 20 is believed to be reduced or substantially avoided. Rather, the majority of the hot gas $H_G$ is believed to flow across the second surface 16 of the substrate 12 between the diffusions sections 20 and over the diffusion sections 20 and the sheets of cooling air $C_A$ therein.

As illustrated in FIG. 1, a portion of the cooling air $C_A$ flows out of each diffusion section 20 over the first sidewall 22A thereof to the second surface 16 of the substrate 12. This portion of the cooling air $C_A$ provides film cooling to the second surface 16 of the substrate 12. Since the mixing of hot gas $H_G$ and cooling air $C_A$ within the diffusion sections 20 is believed to be reduced or substantially avoided, as discussed above, a substantially evenly distributed "curtain" of cooling fluid $C_A$ flows out of each diffusion section 20 and washes up over the second surface 16 of the substrate 12 to provide film cooling to the second surface 16. Film cooling to the second surface 16 of the substrate 12 is believed to be improved by the substantially evenly distributed curtains of cooling fluid $C_A$ flowing out of the respective diffusion sections 20 to the second surface 16.

Figure 4:
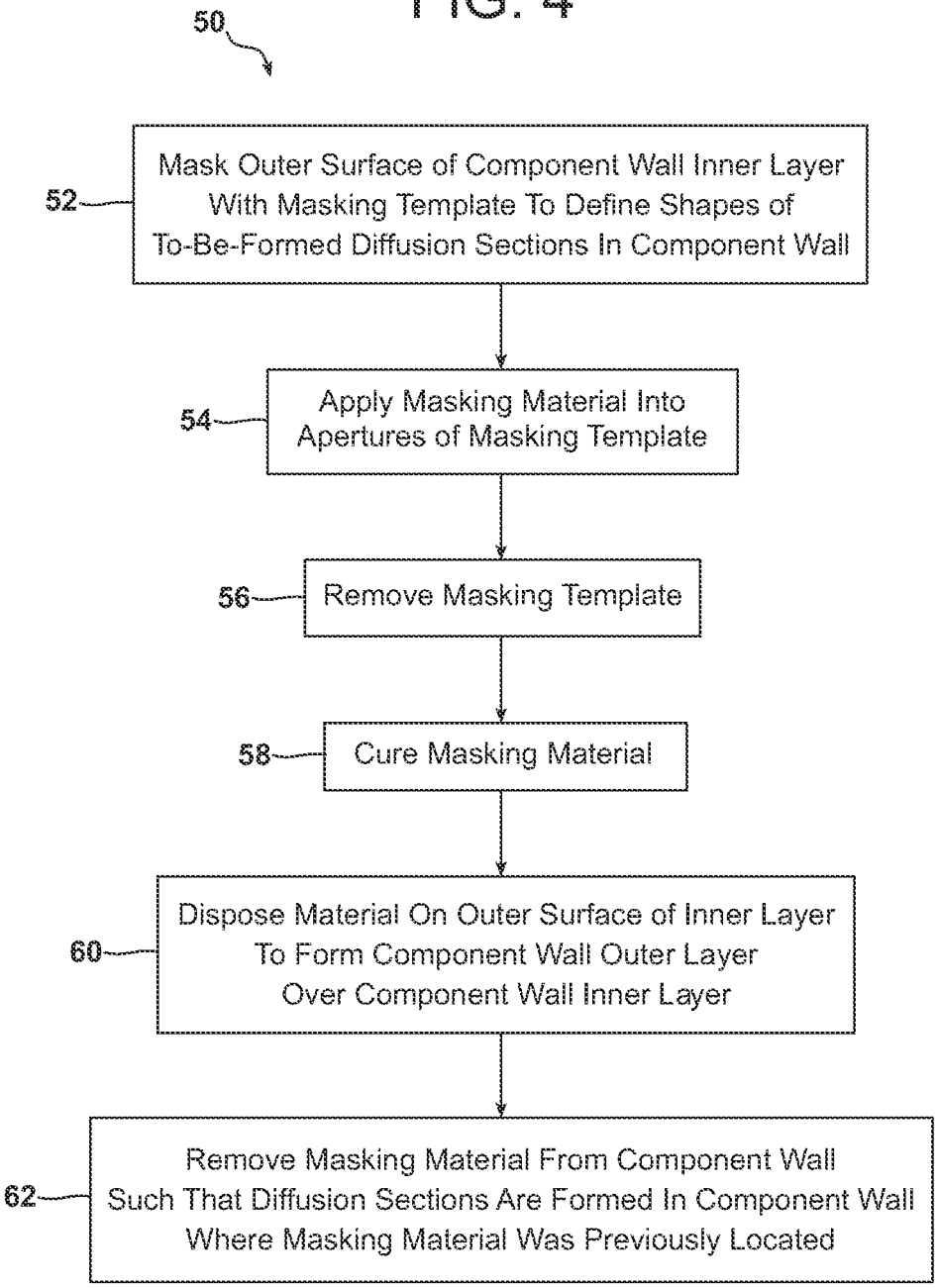
FIG. 4 illustrates a method for forming a plurality of diffusion sections in a component wall according to an embodiment of the invention.

Referring to FIG. 4 and additionally to FIGS. 5-8, a method 50 for forming cooling structure in a component wall of a turbine engine is illustrated. For exemplary purposes, the component wall described herein with respect to FIG. 4 may be the same component wall 10 as described above with reference to FIG. 1-3.

Figure 5:
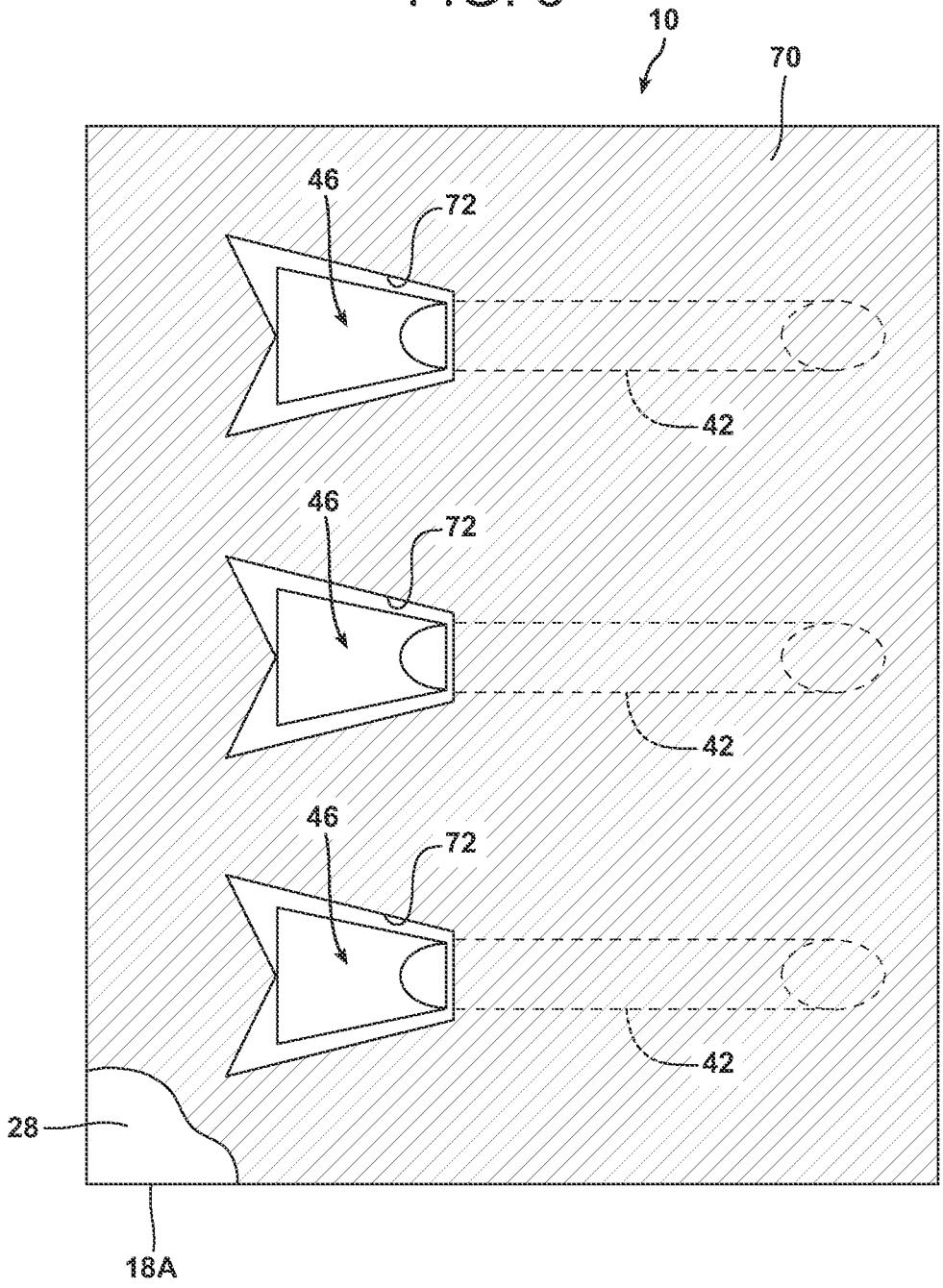
FIGS. 5-8 illustrate steps for forming a plurality of diffusion sections in a component wall according to the method illustrated in FIG. 4.

At step 52, an outer surface 28 of an inner layer 18A of the component wall 10 is masked with a removable masking template 70, illustrated in FIG. 5. The masking template 70 includes a plurality of apertures 72 formed therein. The apertures 72 define shapes of to-be-formed diffusion sections in the component wall 10, as will be described herein. As shown in FIG. 5, the apertures 72 are spaced 1from each other corresponding to spacing between outlets 46 of cooling passages 42 that extend through the inner layer 18A of the component wall 10 such that the outlets 46 of the cooling passages 42 are exposed through the apertures 72. In the embodiment shown, the masking template 70 is configured such that protuberances of the to-be formed diffusion sections will be aligned with outlets 46 of respective ones of the cooling passages 42, as will be discussed herein. The masking template 70 may be, for example, a tape structure or other suitable removable material.

Figure 6:
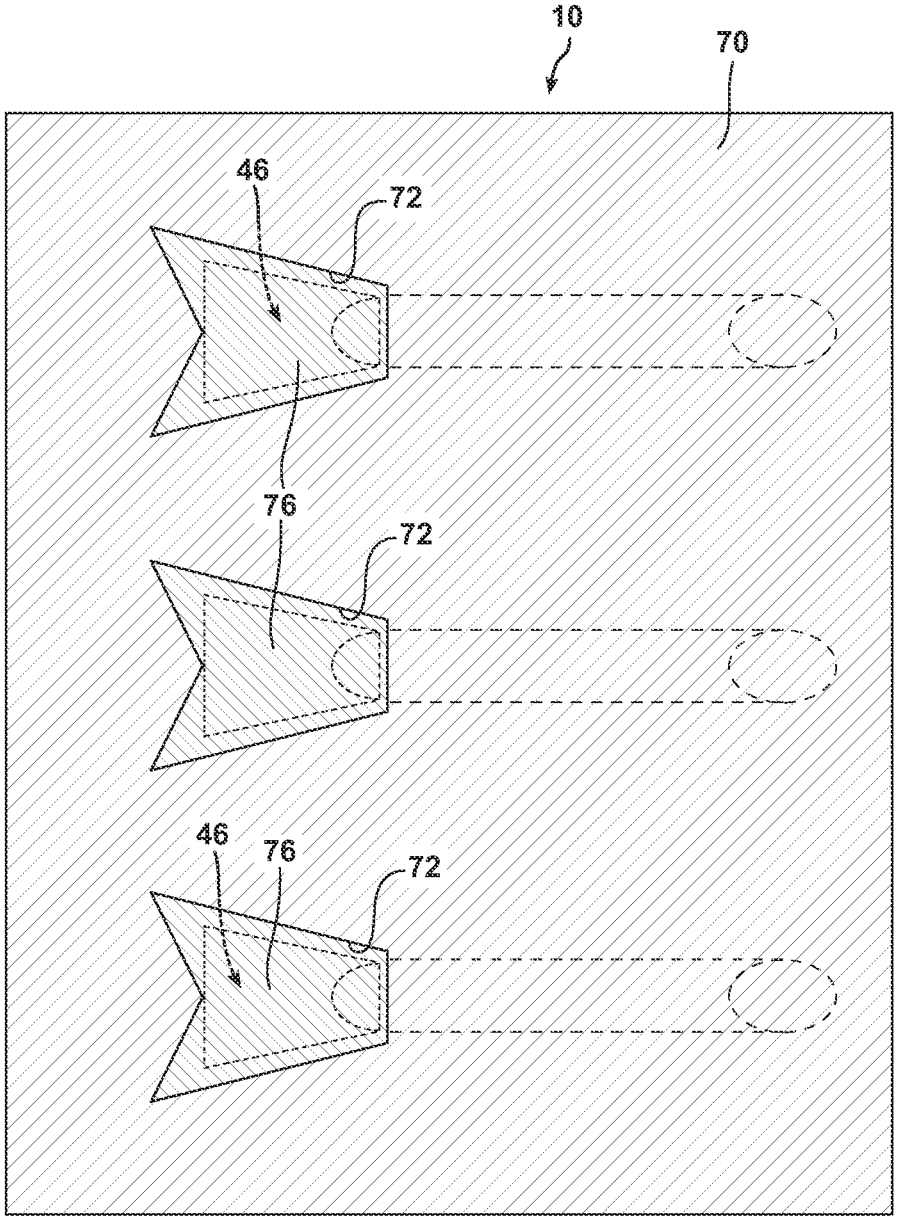

At step 54, a removable masking material 76 is applied to the component wall 10 into the apertures 72 of the masking template 70, as shown in FIG. 6. The masking material 76 may be applied, for example, by spreading the masking material 76 in the form of a paste onto the component wall 10, spray coating the masking material 76 onto the component wall 10, dipping the component wall 10 in the masking material 76, or by any other suitable method. Applying the masking material 76 into the apertures 72 of the masking template 70 blocks the outlets 46 of the cooling passages 42 and substantially fills the apertures 72 so that the masking material 76 defines the shapes of the to-be-formed diffusion sections. The masking material 76 may be formed, for example, from thermosetting or thermoplastic materials, such as epoxy resins, alkyd resins, phenolic resins, acrylic resins, thermoplastic polyesters, polyamides, polyolefins, styrene-based resins, and copolymers or mixtures of the thermoplastic materials.

At step 56, the masking template 70 is removed from the component wall 10, wherein the masking material 76 remains on the component wall 10 where the apertures 72 of the masking template 70 were previously located. Hence, the masking material 76, at this stage of assembly, still blocks the outlets 46 of the cooling passages 42.

At step 58, the masking material 76 is cured. "Curing" of the masking material 76 generally refers to the cooling down and hardening of the masking material 76, although other methods of solidifying or hardening the masking material 76 could be used, as will be apparent to those skilled in the art. It is noted that the masking material 76 could be cured before removing the masking template 70 at step 56, in which case the masking template 70 could be cured along with the masking material 76. This may be desirable, for example, if the masking template 70 is to be disposed of after it is used to form the cooling structure in the component wall 10 as described herein.

Figure 7:
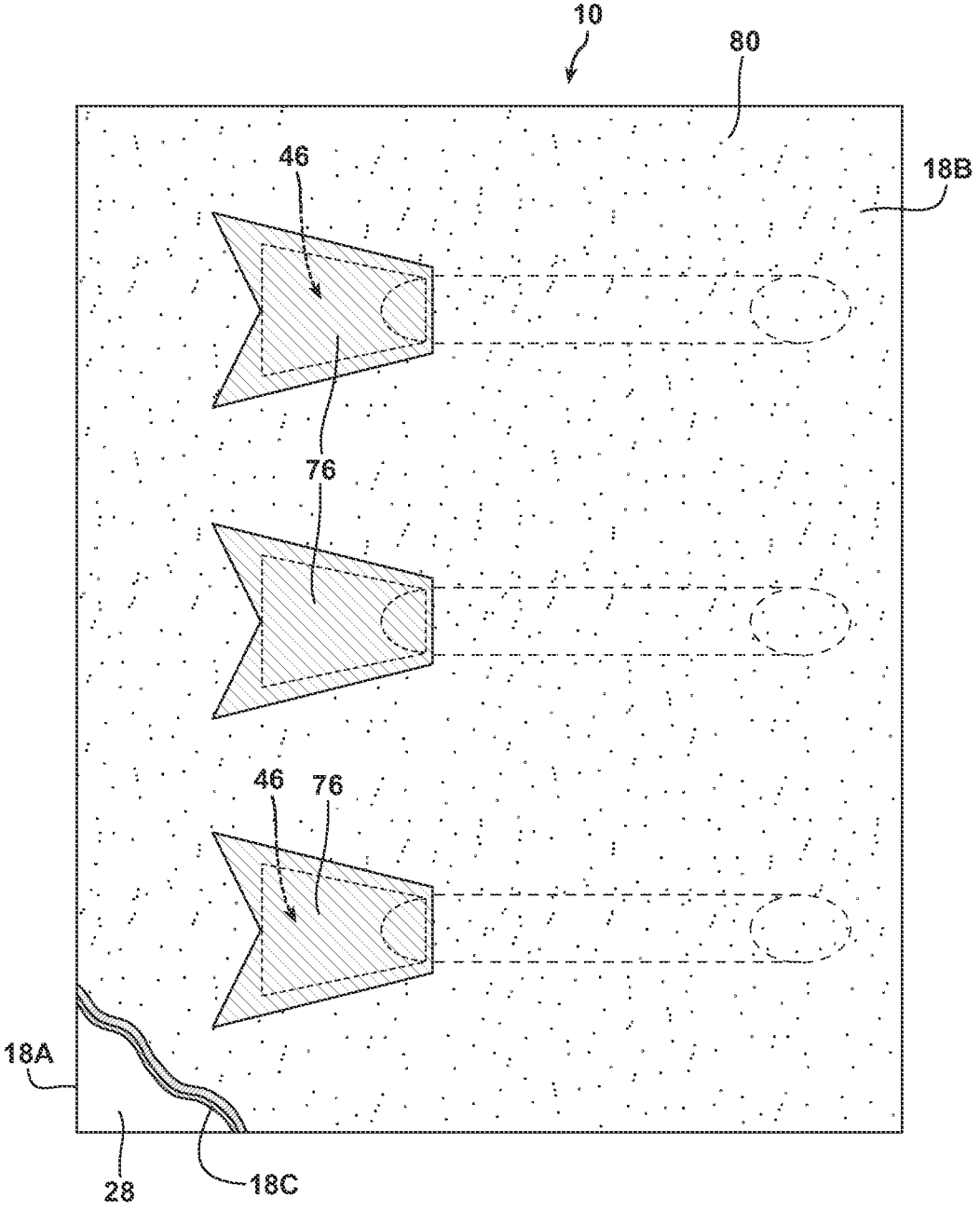

At step 60, a material 80, e.g., a thermal barrier coating, may be disposed on the outer surface 28 of the inner layer 18A to form an outer layer 18B of the component wall 10 over the inner layer 18A, illustrated in FIG. 7. Optionally, prior to disposing the outer layer 18B on the inner layer 18A, an intermediate layer 18C (see FIG. 7), e.g., a bond coat, may be applied to the inner layer 18A to facilitate a bonding of the outer layer 18B to the inner layer 18A. As another option, the bond coat may be applied to the inner layer 18A prior to the masking template 70 being applied to the inner layer 18A at step 52. This would be permissible, as the bond coat will most likely not substantially plug the outlets 46 of the cooling passages 42.

Figure 8:
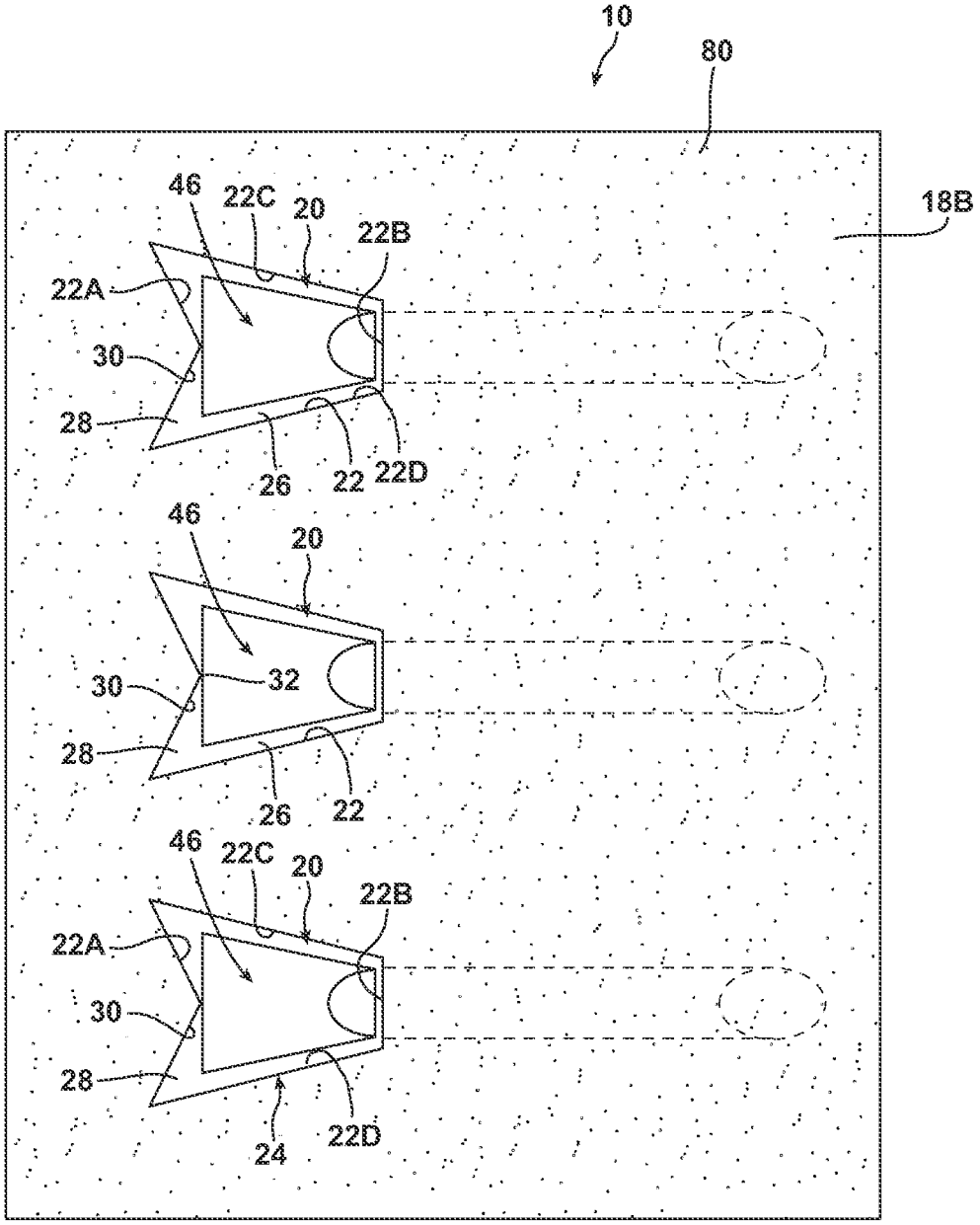

At step 62, the masking material 76 is removed from the component wall 10 such that a plurality of diffusion sections 20 are formed in the component wall 10 where the masking material 76 was previously located, see FIG. 8. The diffusion sections 20 may each be defined by wall structure 22, an open top portion 24, and a bottom surface 26, as described above with respect to FIGS. 1-3. The bottom surface 26 may correspond to the surface area of the outer surface 28 of the inner layer 18A where the masking material 76 was previously located. A first sidewall 22A may be defined by the material forming the outer layer 18B of the component wall 10, and may comprise a protuberance 30 that includes an apex 32 that is aligned with the outlet 46 of the respective cooling passages 42, as described above. Second, third, and fourth sidewalls 22B, 22C, 22D of the wall structure 22 may also be defined by the material forming the outer layer 18B of the component wall 10.

Removing the masking material 76 at step 62 unblocks the outlets 46 of the cooling passages 42 such that cooling air $C_A$ may pass through the cooling passages 42 and out of the outlets 46 thereof toward the protuberance 30 of each respective first sidewall 22A, as described above.

It is noted that the component wall 10 disclosed herein may comprise one or a plurality of diffusion sections 20, craters, trenches, or slots, which may or may not extend over the entire second surface 16 of the substrate 12. If the component wall 10 comprises multiple diffusion sections 20, the number, shape, and arrangement of the corresponding cooling passages 42 and the outlets 46 thereof may be the same or different than as shown in the diffusion sections 20 described herein. Further, the shape of the protuberances 30, as well as the configuration of the first, second, third, and fourth sidewalls 22A-22D may be the same or different than those of the diffusion sections 20 described herein.

Advantageously, increased performance for both cooling and aerodynamics can be realized with the disclosed component wall 10 described herein as compared to existing film-cooled component walls. Further, the method 50 disclosed herein may be employed to efficiently form a plurality of diffusion sections 20 in a component wall 10. Specifically, with the use of the masking template 70 and the masking material 76, all of the cooling passage outlets 46 can be covered in a single step, i.e., with the masking material 76, rather than requiring each of the outlets 46 to be separately covered with individual portions of a masking material. Hence, the time required to form the cooling structure in the component wall 10 and the complexity thereof are reduced as compared to if the outlets 46 of the cooling passages 42 were to be individually covered. Further, with the use of the masking template 70, the shapes of the to-be-formed diffusion sections can be configured as desired.

Referring now to FIG. 9, a component wall 110 having a plurality of diffusion sections 120 formed therein according to another embodiment is shown. In FIG. 9, structure similar to that described above with reference to FIGS. 1-3 includes the same reference number increased by 100. Further, only the structure that is different from that described above with reference to FIGS. 1-3 will be specifically described herein with respect to FIG. 9.

In FIG. 9, protuberances 130 of a first sidewall 122A of each of a plurality of diffusion sections 120 are configured in a smooth, curved pattern defined by a curved wall section 131 of the respective protuberance 130. As indicated by the solid line arrows in FIG. 9, cooling air $C_A$ exiting from outlets 146 of cooling passages 142 is directed toward apexes 132 of the protuberances 130, which apexes 132 are defined by a portion of the curved wall section 131 located closest to a second sidewall 122B of the respective diffusion section 120. Wall portions 130*a*, 130*b* of the curved wall section 131 effect a diverging flow of the cooling air $C_A$ along the first sidewall 122A, which wall portions 130*a*, 130*b* diverge from opposing sides of the apexes 132.

The diffusion sections 20, 120 described herein may be formed as part of a repair process or may be implemented in new airfoil designs. Further, the diffusion sections 20, 120 may be formed by other processes than the one described herein. For example, the substrate 12 may comprise a single layer and the diffusion sections 20, 120 may be machined in an outer surface 16 of the substrate layer.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component wall in a turbine engine comprising:

a substrate having a first surface and a second surface opposed from said first surface;

a plurality of diffusion sections located in said second surface, each said diffusion section defined by a bottom surface between said first and second surfaces, an open top portion located at said second surface, and wall structure extending outwardly continuously from said bottom surface to said second surface, said wall structure surrounding the respective diffusion section and comprising at least a first sidewall, a second sidewall opposed from said first sidewall, a third sidewall extending between said first and second sidewalls, and a fourth sidewall opposed from said third sidewall and extending between said first and second sidewalls, said third and fourth sidewalls diverging from each other;

wherein:

said bottom surface of each said diffusion section is substantially parallel to said second surface, said bottom surface extending from said first sidewall to said second sidewall and from said third sidewall to said fourth sidewall;

said first sidewall of each said diffusion section comprises a protuberance extending toward said second sidewall of the respective diffusion section, each said protuberance formed by a pair of diverging wall portions, said diverging wall portions diverging from each other at a greater angle than an angle of divergence of said third and fourth side walls and intersecting said third and fourth sidewalls at respective downstream junctions;

each said diffusion section comprises a single cooling passage, said cooling passage of each said diffusion section extending through said substrate from said first surface to said bottom surface of the respective diffusion section, wherein an outlet of each said cooling passage is arranged within the respective diffusion section such that cooling air exiting each said cooling passage through said outlet is directed toward said protuberance of the respective first sidewall; and said outlet of said cooling passage includes opposed first and second side edges, said first side edge being generally parallel to said third sidewall of said respective diffusion section and said second side edge being generally parallel to said fourth sidewall of said respective diffusion section.

2. The component wall of claim 1, wherein said first and second sidewalls of said wall structure of each said diffusion section are substantially perpendicular to said second surface.

3. The component wall of claim 1, wherein said protuberance of said first sidewall of each said diffusion section comprises an apex formed by said diverging wall portions and aligned with an outlet of a respective cooling passage to effect a diverging flow of cooling air along said first sidewall to said junctions, and wherein at least one of said protuberances is defined by a curved wall section of said first sidewall, said apex of the respective protuberance defined by a portion of said curved wall section located closest to said second sidewall.

4. The component wall of claim 1, wherein said protuberance of said first sidewall of each said diffusion section comprises an apex formed by said diverging wall portions and aligned with an outlet of a respective cooling passage to effect a diverging flow of cooling air along said first sidewall to said junctions.

5. A component wall in a turbine engine comprising:

a substrate having a first surface and a second surface opposed from said first surface;

a plurality of diffusion sections located in said second surface, each said diffusion section defined by a bottom surface between said first and second surfaces, an open top portion located at said second surface, and wall structure extending outwardly continuously from said bottom surface to said second surface, said wall structure surrounding the respective diffusion section and comprising a first sidewall, a second sidewall opposed from said first sidewall, a third sidewall extending between said first and second sidewalls, and a fourth sidewall opposed from said third sidewall and extending between said first and second sidewalls, said third and fourth sidewalls diverging from each other;

wherein:

said bottom surface of each said diffusion section is substantially parallel to said second surface and extends from said third sidewall to said fourth sidewall;

said first sidewall of each said diffusion section is substantially perpendicular to said second surface and comprises a protuberance extending toward said second sidewall of the respective diffusion section, each said protuberance formed by a pair of diverging wall portions, said diverging wall portions diverging from each other at a greater angle than an angle of divergence of said third and fourth side walls and intersecting said third and fourth sidewalls at respective downstream junctions;

each said diffusion section comprises a single cooling passage, said cooling passage of each said diffusion section extending through said substrate from said first surface to said bottom surface of the respective diffusion section, wherein an outlet of each said cooling passage is arranged within the respective diffusion section such that cooling air exiting each said cooling passage through said outlet is directed toward an apex of the respective protuberance to effect a diverging flow of cooling air along said respective first sidewall; and said outlet of said cooling passage includes opposed first and second side edges, said first side edge being generally parallel to said third sidewall of said respective diffusion section and said second side edge being generally parallel to said fourth sidewall of said respective diffusion section.

6. The component wall of claim 5, wherein at least one of said protuberances is defined by one of:

a curved wall section of said first sidewall, said apex of the respective protuberance defined by a portion of said curved wall section located closest to said second sidewall; and a pair of wall sections of said first sidewall that extend at an angle relative to each other and come together at said apex.

7. A method of forming cooling structure in a component wall of a turbine engine comprising:

masking an outer surface of an inner layer of the component wall with a masking template, said masking template including apertures defining shapes of a plurality of to-be-formed diffusion sections in the component wall, the apertures spaced from each other corresponding to spacing between outlets of cooling passages extending through the inner layer of the component wall such that the outlets of the cooling passages are exposed through the apertures;

applying a masking material to the component wall into the apertures in the masking template so as to block the outlets of the cooling passages;

removing the masking template;

applying a material on the outer surface of the inner layer to form an outer layer of the component wall over the inner layer, the outer layer surrounding the plurality of to-be-formed diffusion sections in the component wall;

removing the masking material from the component wall such that a plurality of diffusion sections are formed in the component wall where the masking material was previously located, wherein each diffusion section is defined by:

a bottom surface corresponding to the surface area of the outer surface of the inner layer of the component wall where the masking material was previously located, wherein the bottom surface is substantially parallel to an outer surface of the outer layer of the component wall;

a first sidewall defined by the material forming the outer layer of the component wall;

a second sidewall spaced from the first sidewall and defined by the material forming the outer layer of the component wall;

a third sidewall extending between the first and second sidewalls; and a fourth sidewall opposed from the third sidewall and extending between the first and second sidewalls, the fourth sidewall diverging from the third sidewall;

wherein:

the outlet of each cooling passage includes opposed first and second side edges, the first side edge being generally parallel to the third sidewall of the respective diffusion section and the second side edge being generally parallel to the fourth sidewall of the respective diffusion section;

the first sidewall of each diffusion section comprises a protuberance extending toward the second sidewall of the respective diffusion section, each protuberance formed by a pair of diverging wall portions, the diverging wall portions diverging from each other at a greater angle than an angle of divergence of the third and fourth side walls and intersecting the third and fourth sidewalls at respective downstream junctions; and said first, second, third, and fourth sidewalls surround each diffusion section and extend outwardly continuously from said bottom surface to said outer layer, said bottom surface of each diffusion section extending from said third sidewall to said fourth sidewall.

8. The method of claim 7, wherein the first sidewall is substantially perpendicular to the bottom surface.

9. The method of claim 8, wherein:

the third sidewall of each diffusion section is substantially perpendicular to the bottom surface thereof;

the fourth sidewall of each diffusion section is substantially perpendicular to the bottom surface thereof; and the second sidewall of each diffusion section is substantially perpendicular to the bottom surface thereof and the bottom surface of each diffusion section extends from the third sidewall to the fourth sidewall thereof.

10. The method of claim 8, wherein the protuberance in each of the first sidewalls is aligned with an outlet of a respective cooling passage.

11. The method of claim 7, further comprising, prior to applying the material on the outer surface of the inner layer, applying a bond coat to the outer surface of the inner layer of the component wall, and wherein applying a material on the outer surface of the inner layer comprises applying a thermal barrier coating on the bond coat.

12. The method of claim 7, further comprising, subsequent to applying a masking material and prior to applying the material on the outer surface of the inner layer, curing the masking material.

13. The component wall of claim 1, wherein said third and fourth sidewalls of each said diffusion section diverge away from each other as they extend away from said second sidewall.

14. The component wall of claim 13, wherein said third and fourth sidewalls of each said diffusion section are angled about 10 degrees relative to an axis of said cooling passage associated with said respective diffusion section.

15. The component wall of claim 1, wherein said diffusion sections have different exit portion shapes than exit portion shapes of said cooling passages associated with the respective diffusion sections.

16. The component wall of claim 5, wherein said third and fourth sidewalls of each said diffusion section diverge from each other as they extend away from said second sidewall.

17. The component wall of claim 16, wherein said third and fourth sidewalls of each said diffusion section are angled about 10 degrees relative to an axis of said cooling passage associated with said respective diffusion section.

18. The component wall of claim 5, wherein said diffusion sections have different exit portion shapes than exit portion shapes of said cooling passages associated with the respective diffusion sections.

* * * * *